US009092041B1

(12) United States Patent
Somerville

(10) Patent No.: US 9,092,041 B1
(45) Date of Patent: Jul. 28, 2015

(54) CURRENT MIRROR CIRCUIT CONFIGURED TO ADJUST A BODY TO SOURCE VOLTAGE OF AN INPUT DEVICE

(75) Inventor: Thomas A. Somerville, Tempe, AZ (US)

(73) Assignee: Maxim Integrated Products, Inc., San Jose, CA (US)

( * ) Notice: Subject to any disclaimer, the term of this patent is extended or adjusted under 35 U.S.C. 154(b) by 461 days.

(21) Appl. No.: 13/559,728

(22) Filed: Jul. 27, 2012

(51) Int. Cl.
*G05F 3/16* (2006.01)

(52) U.S. Cl.
CPC ..... *G05F 3/16* (2013.01)

(58) Field of Classification Search
USPC ..... 323/315, 316
See application file for complete search history.

(56) References Cited

U.S. PATENT DOCUMENTS

2008/0072181 A1* 3/2008 Baumgartner et al. ..... 716/1
2013/0043957 A1* 2/2013 Shibata ..... 331/108 R
2014/0084975 A1* 3/2014 Tang et al. ..... 327/156

* cited by examiner

*Primary Examiner* — Jeffrey Sterrett
(74) *Attorney, Agent, or Firm* — Advent, LLP

(57) ABSTRACT

A current mirror circuit that is configured to adjust a body to source voltage of an input device in response to a drain to source voltage of an output device is disclosed. In an implementation, the current mirror circuit comprises a current mirror including an input device and an output device coupled together. The current mirror circuit also includes a feedback circuit component coupled between the output of the current mirror and the input device. The feedback circuit component is configured to adjust a body to source voltage of the input device in response to a drain to source voltage of the output device.

20 Claims, 4 Drawing Sheets

CURRENT MIRROR CIRCUIT CONFIGURED TO ADJUST A BODY TO SOURCE VOLTAGE OF AN INPUT DEVICE

BACKGROUND

A current mirror is a circuit designed to emulate a current through one active device by controlling the current in another active device of a circuit, keeping the output current constant regardless of loading. The current being emulated can be a varying signal current. Current mirrors can be used in analog circuits as biasing, reference, and simple current-operator circuit elements. Common usages for current mirrors are in output amplifiers and linear regulators. Line regulation is the capability to maintain a constant output voltage level on an output channel despite changes to the input voltage level.

Current mirrors can be characterized by a transfer ratio, in the case of a current amplifier, or the output current magnitude, in the case of a constant current source. Current mirrors can also be characterized by an alternating current (AC) output resistance and by a minimum voltage drop, referred to as dropout voltage. The output resistance determines how much the output current varies with the output voltage applied to the current mirror. The dropout voltage is the smallest possible difference between the input voltage and output voltage to remain within the intended operating range of the device. This minimum voltage is dictated by the need to keep the output transistor of the current mirror in active mode.

Two important characteristics of output amplifiers and linear regulators are minimum supply voltage at maximum rated output current and output voltage variation from minimum to maximum supply voltage. There is usually a tradeoff between these two characteristics; minimum gate length of common source output metal-oxide-semiconductor (MOS) device minimizes dropout voltage while increasing supply sensitivity at low output current. Supply sensitivity is increased at low output current due to reduced amplifier open loop gain and lower effective "Early" voltage of output device operating in moderate or weak inversion. Increasing open loop amplifier or regulator direct current (DC) gain reduces DC supply sensitivity, but stable feedback requires gain to "roll-off" as frequency increases. This results in increased supply sensitivity with increasing frequency.

SUMMARY

A current mirror circuit that is configured to adjust a body to source voltage of an input device in response to a drain to source voltage of an output device is disclosed. In an implementation, the current mirror circuit comprises a current mirror including an input device and an output device coupled together. The current mirror circuit also includes a feedback circuit component coupled between the output of the current mirror and the input device. The feedback circuit component is configured to adjust a body to source voltage of the input device in response to a drain to source voltage of the output device.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DRAWINGS

The Detailed Description is described with reference to the accompanying figures. The use of the same reference numbers in different instances in the description and the figures may indicate similar or identical items.

DETAILED DESCRIPTION

Overview

Figure 1:
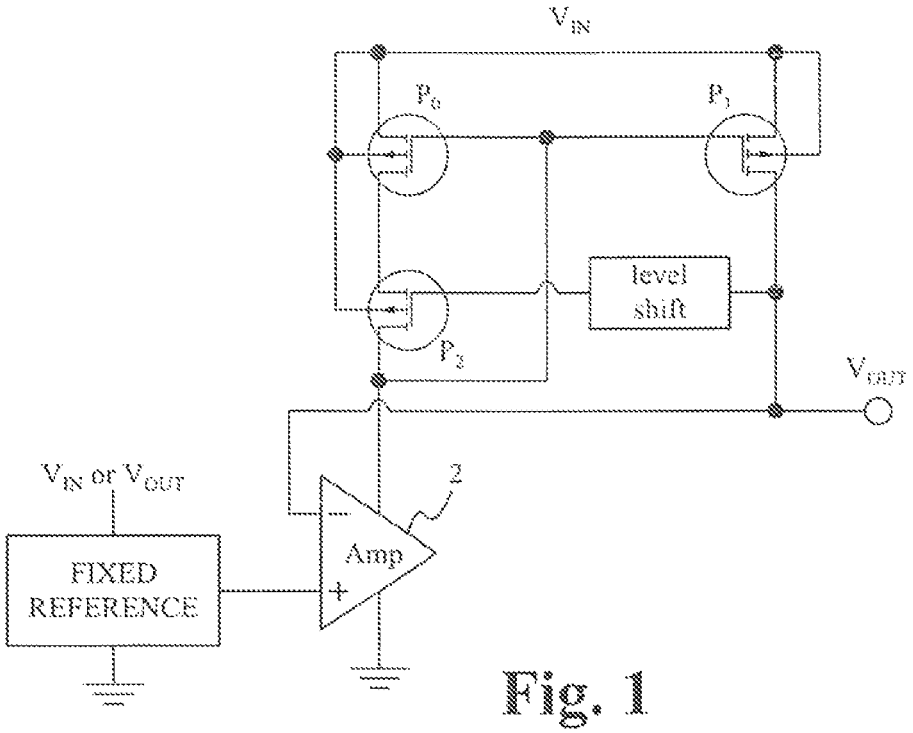
FIG. 1 is a circuit diagram that illustrates an example current mirror circuit design in accordance with the present disclosure.

A number of current mirror circuit designs have been implemented to provide accurate transfer gain, within a high frequency band, while exhibiting low input and high output resistance. FIG. 1 illustrates a current mirror circuit design. In this exemplary application, the current mirror is implemented as part of an output stage within a reference output buffer amplifier. A positive input to the amplifier 2 is a fixed voltage reference. A negative input to the amplifier 2 is a feedback voltage, specifically, the output voltage $V_{OUT}$. The amplifier 2 includes a first power supply lead coupled to the supply voltage $V_{IN}$, and the amplifier 2 includes a second power supply lead coupled to ground. In this exemplary application, the amplifier 2 is an output amplifier intended to buffer the voltage reference from any loads at the output. Such an implementation can be found in applications that require sourcing or sinking current. Instead of current being supplied directly by the reference, such as the fixed reference block in FIG. 1, the amplifier provides a load current at the output where the output matches the input with as little error as possible. One of the error sources is if the supply $V_{IN}$ moves up and down.

The schematic current mirror circuit is shown in FIG. 1 external to the amplifier 2 for illustrative purposes only. In implementation, the current mirror is configured as part of the output stage within the amplifier 2. The current mirror shown in FIG. 1 is the top portion of the output stage and supplies sourcing current from the supply $V_{IN}$ to the output $V_{OUT}$. The remaining portion of the amplifier circuit is included within the amplifier symbol 2 and is not shown in FIG. 1. Although not shown, the bottom portion of the output stage includes another current source in the output stage that pulls current to ground. Requirements on the bottom current source are relaxed relative to the top portion because the output voltage $V_{OUT}$ does not change. Since the output voltage $V_{OUT}$ does not change, and the load is grounded, there is not a line regulation effect. It is only the positive supply $V_{IN}$ changing relative to the output $V_{OUT}$ that is going to result in a line regulation effect. In implementation, the output device on the bottom portion can have short channel length without negatively effecting the line regulation.

The current mirror includes a transistor $P_0$, a transistor $P_1$, a transistor $P_2$, and a level shifter. The transistor $P_0$ functions as an input device for the current mirror, and the transistor $P_1$ functions as an output device for the current mirror. The gate of the transistor $P_0$ is coupled to the gate of the transistor $P_1$. The source and the body of the transistor $P_0$ are coupled to the supply voltage $V_{IN}$, and the source and the body of the transistor $P_1$ are also coupled to the supply voltage $V_{IN}$. As such, the sources of the transistors $P_0$ and $P_1$ are coupled together, and the bodies of the transistors $P_0$ and $P_1$ are coupled together. The drain of the transistor $P_0$ is coupled to the source of the transistor $P_2$. The gate of the transistor $P_0$ and the gate of the transistor $P_1$ are coupled to the drain of the transistor $P_2$. The output of the current mirror is coupled to the drain of the transistor $P_1$. The level shifter is coupled between the drain of the transistor $P_1$ and the gate of the transistor $P_2$. The body of the transistor $P_2$ is coupled to the supply voltage $V_{IN}$. The drain of the transistor $P_2$ is coupled to a bottom half (not shown) of the output stage of the amplifier 2. In operation, the drain voltage of the transistor $P_0$ is adjusted to track the drain voltage of the transistor $P_1$. As such, the gate shared by the transistor $P_0$ and the transistor $P_1$ is adjusted automatically by the transistor $P_0$ to whatever voltage is needed to result in a constant output current. The current mirror of FIG. 1 may include additional head room for the level shifter and the transistor $P_2$. Gate voltage of $P_2$ is at least approximately equal to $V_{OUT}$ minus the source to gate voltage of $P_2$, therefore $V_{OUT}$ cannot be less than gate voltage of $P_2$ plus source to gate voltage of $P_2$. Depending on process, this could preclude reference output voltage below 1.3V. Such a configuration also prevents this current mirror from working at low supply voltages. $V_{IN}$ may be greater than $V_{OUT}$ plus source to drain voltage of $P_1$. Therefore increased $V_{OUT}$ requirement also increases $V_{IN}$ requirement. As such, the current mirror of FIG. 1 may have a higher supply voltage and more die area to accommodate $P_2$ and level shift circuitry.

In an effort to reduce the minimum supply voltage at maximum rated output current for the current mirror, the gate length of the output transistor $P_1$ can be shortened and the gate width widened, which effectively lowers the channel resistance $RDSON=1/gm=[\mu CoxW/L(VGS-VT)]^{-1}$. However, the shorter transistor gate length negatively affects the line regulation of the current mirror because the output resistance of the device $ro=1/(\lambda Id)$ is lowered with reduced gate length. As such, there is a trade-off between improving the on-resistance of the current mirror and concurrently lowering the output resistance. Line regulation$=\delta V_{OUT}/\delta V_{IN}=\delta VGSP1/[(Av)(\delta V_{IN})]$, where Av is amplifier open loop gain from input to gate of output PMOS device $P_1$. The output resistance of $P_1$, $Ro=\delta VDS/\delta VD=W_{IN}/[\delta(VGS)gm]$ for constant $V_{OUT}$. Substituting $\delta V_{IN}/\delta VGS$ into line regulation equation gives line regulation$=1/gmRoAv$.

Figure 2:
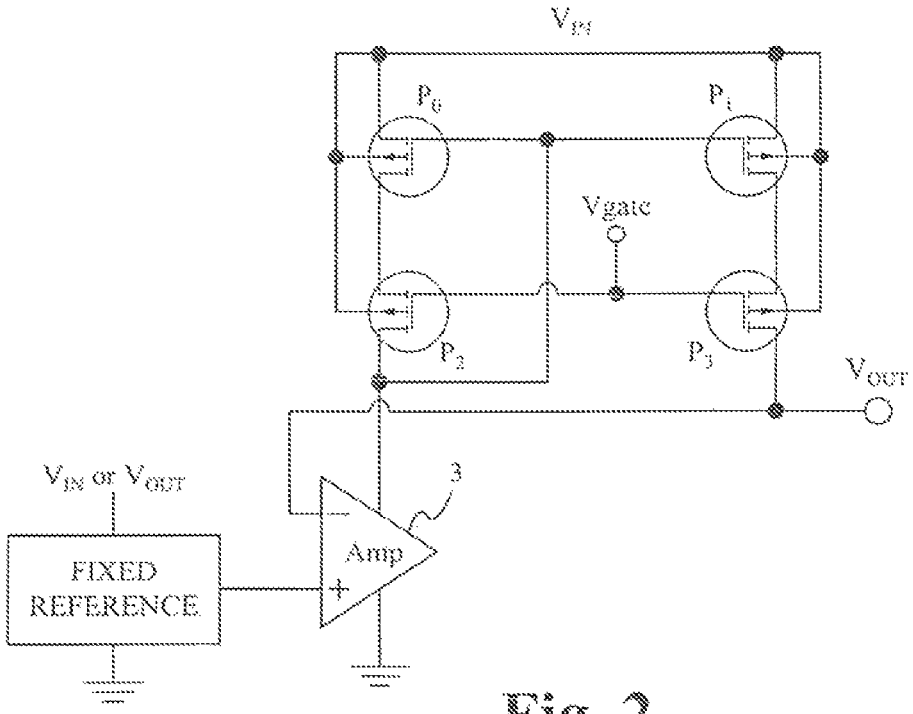
FIG. 2 is a circuit diagram that illustrates an example current mirror circuit design configured as a cascode.

The current mirror of FIG. 1 can be modified as a cascode circuit in order to increase the device output resistance. FIG. 2 illustrates a conventional current mirror circuit design configured as a cascode. Similar to the current mirror of FIG. 1, the exemplary cascode current mirror of FIG. 2 is implemented as part of an output stage within a reference output buffer amplifier. A transistor $P_3$ is coupled to the transistor $P_1$ to form a cascode. Configuring the transistor $P_3$ between the output driving transistor $P_1$ and the output $V_{OUT}$ keeps the drain to source voltage of transistor $P_0$ and $P_1$ equal even if the supply voltage $V_{IN}$ changes. However, the additional device $P_3$ compromises the drop out voltage. Further, the transistor $P_3$ may be as large as the transistor $P_1$ because both transistors are conducting the same amount of current. Still further, in order to achieve the same minimum differential voltage between the supply voltage $V_{IN}$ and the output voltage $V_{OUT}$, both devices $P_1$ and $P_3$ have to be bigger because there are now two devices in series, rather than one transistor, as in the current mirror in FIG. 1. This also results in a larger die size. In some current mirror applications which might not require a high output current, this requirement may not be a drawback as smaller sized transistors can be used. In fact, this would be preferable over the proposed solution if the output current is low. However, for higher output current applications, such as +/−10 mA, the cascode configuration is not desirable due to the required size of the devices.

Figure 3:
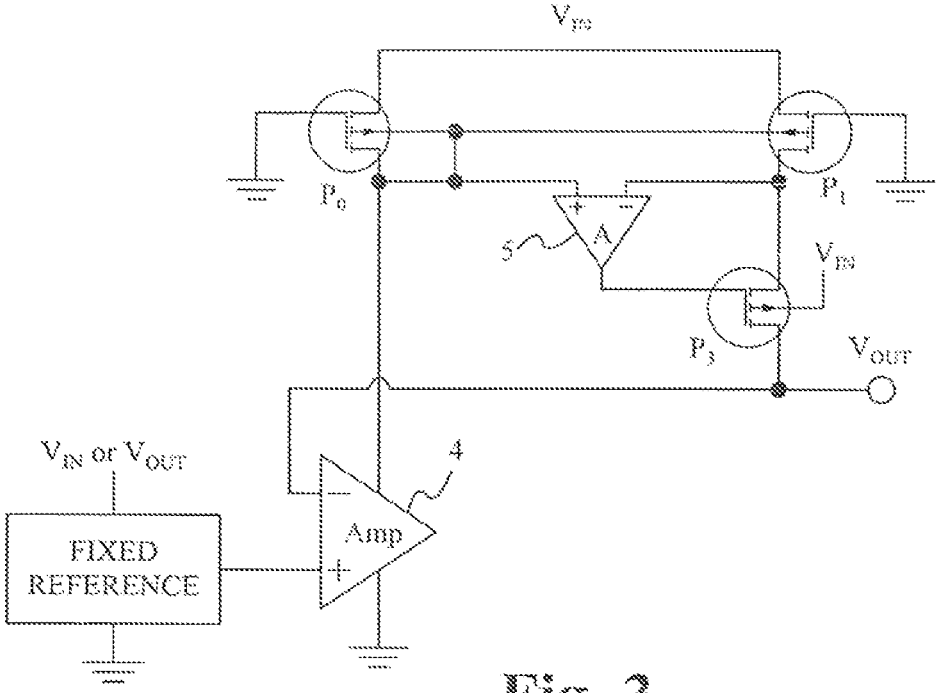
FIG. 3 is a circuit diagram that illustrates an example body driven based current mirror circuit design.

Other current mirror configurations use the transistor body as an input terminal while keeping the gate voltage constant to turn the transistor on. This is referred to as a body-driven technique. FIG. 3 illustrates a conventional body driven based current mirror circuit design. The gate of the transistor $P_0$ is coupled to ground, and the gate of the transistor $P_1$ is coupled to ground. The source of the transistor $P_0$ is coupled to the supply voltage $V_{IN}$, and the source of the transistor $P_1$ is also coupled to the supply voltage $V_{IN}$. As such, the sources of the transistors $P_0$ and $P_1$ are coupled together. The body of the transistor $P_0$ is coupled to the body of the transistor $P_1$ and therefore the body voltages of the two transistors is the same. The drain of the transistor $P_0$ is coupled to the bodies of the transistors $P_0$ and $P_1$ and also to the positive input of amplifier 5. The drain of the transistor $P_1$ is coupled to negative input of the amplifier 5 and to the source of the transistor $P_3$. The output of the amplifier 5 is coupled to the gate of the transistor $P_3$. The output of the current mirror is coupled to the drain of the transistor $P_3$. The body of the transistor $P_3$ is coupled to the supply voltage $V_{IN}$. The drain of the transistor $P_0$ is coupled to a bottom half (not shown) of the output stage of the amplifier 4. Similarly to the current mirror of FIG. 2, the size of the transistor $P_3$ may be as large as the transistor $P_1$ because both transistors are conducting the same amount of current. This results in larger die size. Further, the current mirror configuration of FIG. 3 is impractical when trying to reduce the current mirror supply voltage to its minimum level.

Figure 4:
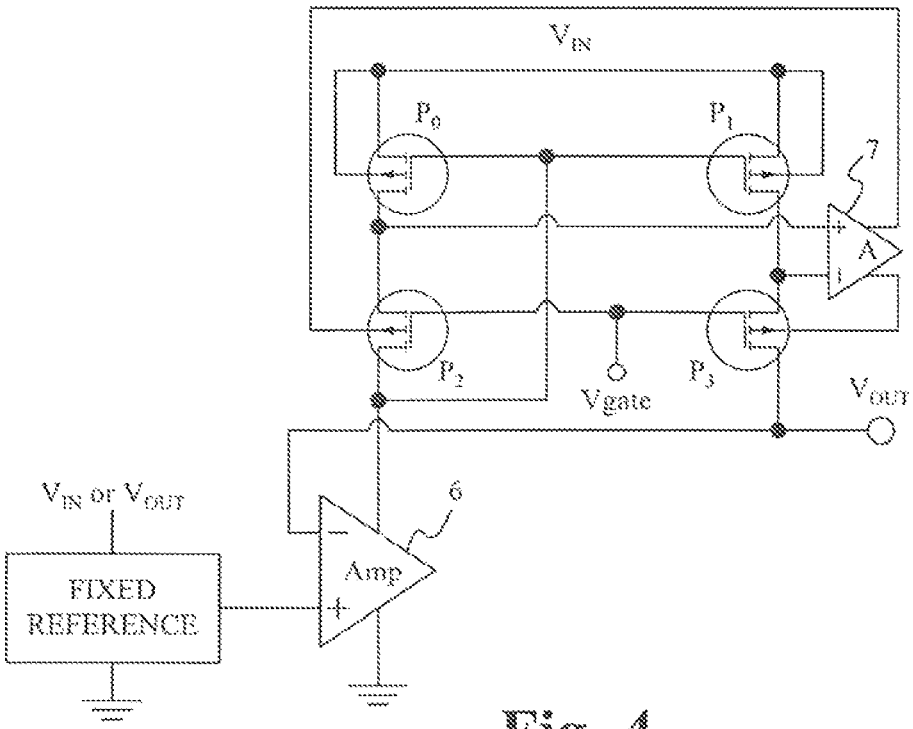
FIG. 4 is a circuit diagram that illustrates another conventional body driven based current mirror circuit design.

FIG. 4 illustrates another body driven based current mirror circuit design. The current mirror of FIG. 4 is similar to the current mirror configuration of FIG. 2 except that the current mirror of FIG. 4 includes a differential amplifier 7, and the bodies of the transistors $P_2$ and $P_3$ are driven by the outputs of the differential amplifier 7. In comparison to the body driven current mirror of FIG. 3, the current mirror of FIG. 4 has no body voltage adjustment on transistors $P_0$ and $P_1$. Instead, the bodies of the transistors $P_0$ and $P_1$ are coupled to the supply voltage $V_{IN}$. However, the bodies of both transistors $P_2$ and $P_3$ are driven, by the outputs of the differential amplifier 7, but the transistors $P_2$ and $P_3$ are not the current mirror input or output devices. The current mirror input device is the transistor $P_0$ and the current mirror output device is the transistor $P_1$. The transistors $P_2$ and $P_3$ are the cascode devices. In operation, the circuit servos until the two drain voltages of the transistors $P_1$ and $P_2$ are equal, and to get these two equal, the circuit drives the bodies of the transistors $P_2$ and $P_3$ with the difference output from the differential amplifier 7. As with the current mirror of FIG. 3, the current mirror of FIG. 4 also has a larger die size due to the additional cascode device $P_3$.

The present disclosure is directed to a current mirror circuit that is configured to adjust a body to source voltage of an input device in response to a drain to source voltage of an output device is disclosed. In an implementation, the current mirror circuit comprises a current mirror including an input device and an output device coupled together. The current mirror circuit also includes a feedback circuit component coupled between the output of the current mirror and the input device. The feedback circuit component is configured to adjust a body to source voltage of the input device in response to a drain to source voltage of the output device.

Reference is now made in detail to implementations of the current mirror circuit as illustrated in the accompanying drawings. The same reference indicators are used throughout the drawings and the following detailed description to refer to the same or like parts. In the interest of clarity, not all of the routine features of the implementations described herein are shown and described. It will, of course, be appreciated that in the development of any such actual implementation, numerous implementation-specific decisions may be made in order to achieve the developer's specific goals, such as compliance with application and business related constraints, and that these specific goals will vary from one implementation to another and from one developer to another. Moreover, it should be appreciated that such a development effort may be complex and time-consuming, but would nevertheless be a routine undertaking of engineering for those of ordinary skill in the art having the benefit of this disclosure.

Example Implementations

Figure 5:
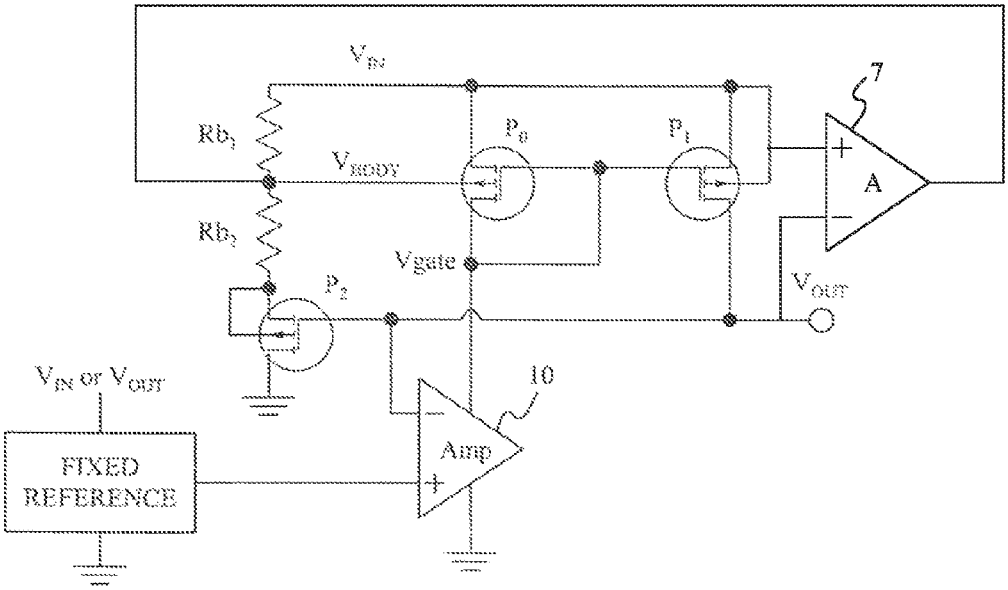
FIG. 5 is a circuit diagram that illustrates a current mirror circuit in accordance with an example implementation of the present disclosure.

FIG. 5 illustrates a current mirror circuit according to an example embodiment of the present disclosure. In an exemplary application, the current mirror circuit is implemented as part of an output stage within a reference output buffer amplifier. It is understood that the current mirror circuit can be implemented in other configurations where a stable output relative to a changing input is desirable. A positive input to the amplifier 10 is a fixed voltage reference. A negative input to the amplifier 10 is a feedback voltage, specifically, the output voltage $V_{OUT}$. The amplifier 10 includes a first power supply lead coupled to the supply voltage $V_{IN}$, and the amplifier 10 includes a second power supply lead coupled to ground. In this exemplary application, the amplifier 10 is an output amplifier intended to buffer the voltage reference from loads at the output.

The schematic current mirror circuit is shown in FIG. 5 external to the amplifier 10 for illustrative purposes only. In implementations, the current mirror circuit may be configured as part of the output stage within the amplifier 10. The current mirror circuit shown in FIG. 5 is the top portion of the output stage and supplies sourcing current from the supply $V_{IN}$ to the output $V_{OUT}$. The remaining portion of the amplifier circuit is included within the amplifier symbol 10 and is not shown in FIG. 5. Although not shown, the bottom portion of the output stage includes another current source in the output stage that pulls current to ground. Requirements on the bottom current source are relaxed relative to the top portion because the output voltage $V_{OUT}$ does not change. Since the output voltage $V_{OUT}$ does not change, and the load is grounded, then there is not a line regulation effect. It is only the positive supply $V_{IN}$ changing relative to the output $V_{OUT}$ that is going to result in a line regulation effect. In implementation, the output device length on the bottom portion can be made small without negatively effecting the line regulation.

The current mirror circuit includes a transistor $P_0$, a transistor $P_1$, a transistor $P_2$, a resistor $Rb_1$, and a resistor $Rb_2$. The transistor $P_0$ functions as an input device for the current mirror, and the transistor $P_1$ functions as an output device for the current mirror. The gate of the transistor $P_0$ is coupled to the gate of the transistor $P_1$, and the gates of the transistors $P_0$ and $P_1$ are coupled to the drain of the transistor $P_0$. The source of the transistor $P_0$ is coupled to the supply voltage $V_{IN}$, and the source of the transistor $P_1$ is coupled to the supply voltage $V_{IN}$. As such, the sources of the transistors $P_0$ and $P_1$ are coupled together. The body of the transistor $P_1$ is also coupled to the supply voltage $V_{IN}$. The output of the current mirror is coupled to the drain of the transistor $P_1$. The resistors $Rb_1$ and $Rb_2$ form a voltage divider coupled to the supply voltage $V_{IN}$, the body of the transistor $P_0$, and the source of the transistor $P_2$. The transistor $P_2$ is coupled between the drain of the transistor $P_1$ and the resistor $Rb_2$. The body of the transistor $P_2$ is coupled to the source of the transistor $P_2$. The drain of the transistor $P_2$ is coupled to ground. The gate of the transistor is coupled to the drain of the transistor $P_1$. The drain of the transistor $P_0$ is coupled to a bottom half of the output stage of the amplifier 10. In some implementations, the transistors $P_0$, $P_1$, and $P_2$ are p-type MOS field effect transistors (FETs), as shown in FIG. 5. It is understood that alternative body-driven transistor types can be used.

Figure 6:
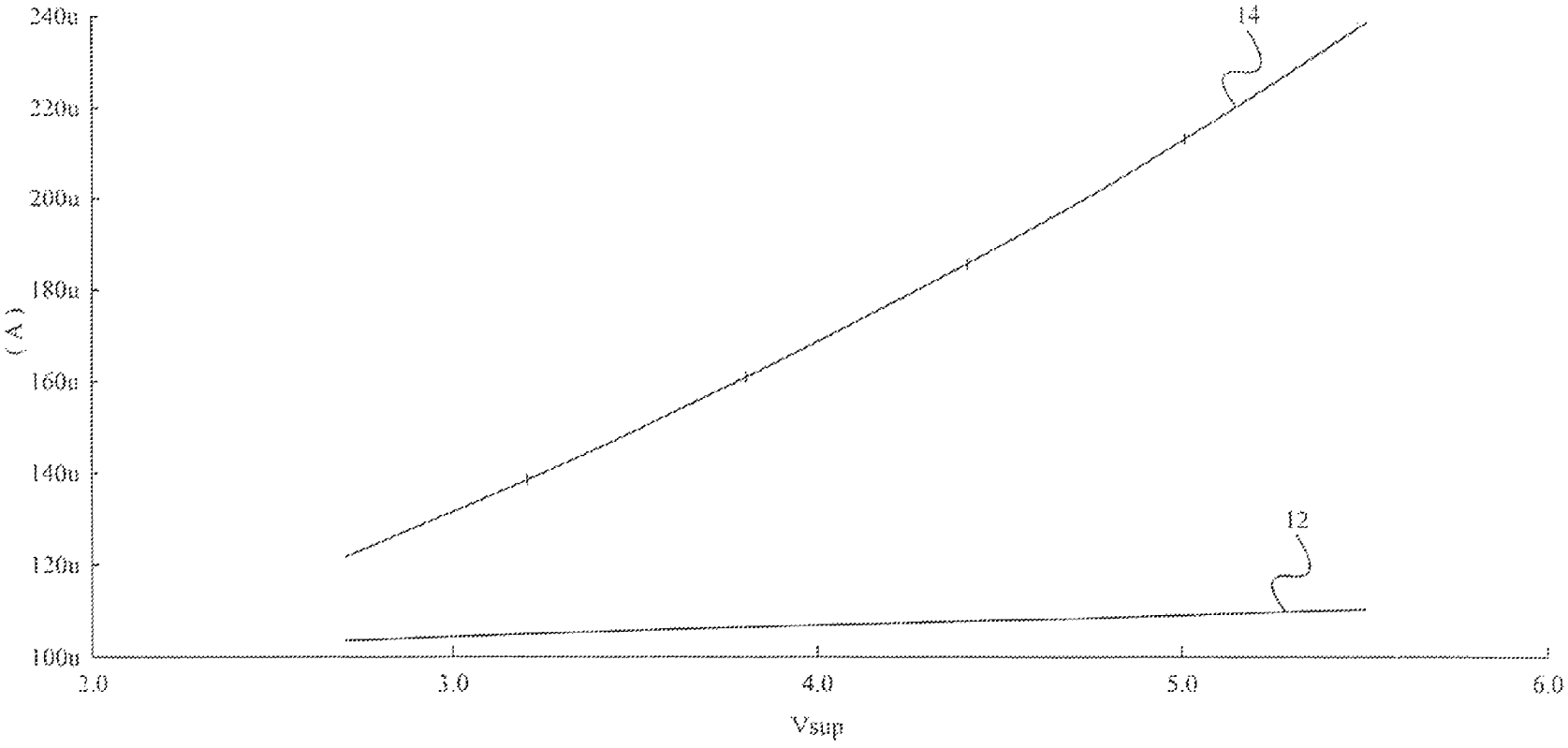
FIG. 6 is a graph that illustrates example simulation results for the current mirror shown in FIG. 5.

The current mirror circuit is configured to provide a feedback compensation so that as the supply voltage $V_{IN}$ moves up or down, the output voltage $V_{OUT}$ does not change. The gate length of the transistor $P_1$ is minimized to reduce dropout voltage. In some implementations, the gate length of the transistor $P_0$ is the same as the transistor $P_1$ for accurate ratio of $P_1$ to $P_0$ drain current. Minimum gate length devices exhibit reduced output resistance due to reduction of threshold voltage as drain to source voltage increases. This is referred to as the "short channel effect." Variation in the supply voltage $V_{IN}$ results in variations of the source to drain voltage of the transistor $P_1$ while the source to drain voltage of the transistor $P_0$ is fixed. The buffered voltage divider formed by the transistor $P_2$, the resistor $Rb_1$, and the resistor $Rb_2$ drives the body of the transistor $P_0$ with a fraction of $V_{OUT}-VGSP_2$ (gate to source voltage of the transistor $P_2$) to reduce the threshold voltage of the transistor $P_0$ as the supply voltage $V_{IN}$ increases. Therefore, both $P_0$ and $P_1$ experience reduced threshold voltage as $V_{IN}$ increases resulting in less change in current ratio between the transistor $P_0$ and the transistor $P_1$. At low output current, the transistors $P_0$ and $P_1$ are operating in moderate or weak inversion ($VGS-VT<0.2V$), a region where drain current is more sensitive to threshold voltage variation. Therefore, this scheme significantly improves line regulation for load current <1% of rated value, as shown in FIG. 6 example at 100 uA.

In operation, the output voltage $V_{OUT}$ is fed back to the body of the transistor $P_0$ so as to compensate for changes in the supply voltage $V_{IN}$. As the supply voltage $V_{IN}$ increases, the source to body voltage VSB of transistor $P_0$ also increases. However, the body voltage VSB does not increase at the same rate as the increase in the supply voltage $V_{IN}$. This is due to the voltage divider formed by the resistors $Rb_1$ and $Rb_2$. MOSFET threshold voltage is modeled by $Vt=Vt_o+\gamma[\sqrt{(2\phi_f+VSB)}-\sqrt{(2\phi_f)}]$, $\gamma=\sqrt{(2q\epsilon N_A)}/Cox$. Gamma ($\gamma$) is the process dependent coefficient of threshold voltage sensitivity to VSB; a typical value is $0.6\sqrt{N}$. The signal path from the output $V_{OUT}$ through the transistor $P_2$ and the voltage divider to the body of the transistor $P_0$ provides feedback so that as the drain to source voltage across the transistor $P_1$ increases, the gate to source voltage of both transistors $P_0$ and $P_1$ may decrease. This compensates for the change in the supply voltage $V_{IN}$. In this manner, the transistor $P_1$ functions as if it has a longer gate channel length than it really does because of the feed back result at the gate to compensate for voltage changes at the drain.

The ratio of the voltage divider is determined according to the body effect coefficient gamma of the transistor $P_0$, which is a parameter of the particular process used to fabricate the transistor. The body effect can be determined empirically, it can be simulated, or it can be calculated. In general, the resistor $Rb_1$ is much smaller than the resistor $Rb_2$. The bigger the resistor $Rb_1$, the more correction is being applied. In an example, if $V_{IN}-V_{OUT}$ increases by 3V, then the body voltage VSB may only increase about 0.1V, which reduces the threshold voltage of the transistor $P_0$ at least approximately 0.03V.

There is no significant current at the body of the transistor $P_0$ because the body to source junction of the transistor $P_0$ is a reverse biased junction. As such, the size of the resistors can be large, such as megaohms. In an exemplary implementation, the resistor $Rb_2$ is on the order of 100 Kohms, and the resistor $Rb_1$ is on the order of 10 Kohms. Different sized resistors can be used.

The combination of the resistors $Rb_1$ and $Rb_2$ with the transistor $P_2$ forms a buffered voltage divider because the transistor $P_2$ isolates the voltage divider from the output. In other words, no current flows from the output through the resistors $Rb_1$ and $Rb_2$ because the gate current of the transistor $P_2$ is about zero. As such, the transistor $P_2$ functions as a buffer between the voltage divider and the output. Additionally, the transistor $P_2$ functions as a level shifter. The voltage supplied to the voltage divider at the source of the transistor $P_2$ is equal to the voltage output $V_{OUT}$ minus the gate to source voltage Vgs of the transistor $P_2$. When the supply voltage $V_{IN}$ drops to the point where the output $V_{OUT}$ is within a gate to source voltage Vgs of the supply voltage $V_{IN}$, then the amount of feedback at the body of the transistor $P_0$ is zero, as desired. In other words, since the gate and drain of the transistor $P_0$ are shorted together, the gate voltage of the transistor $P_0$ is equal to the drain voltage, which means Vds is equal to Vgs, and in that condition it is desired that the body voltage Vbody equal the supply voltage $V_{IN}$. The transistor $P_2$ makes this the case for both the transistors $P_0$ and $P_1$.

The exemplary circuit shown in FIG. 5 uses a feedback circuit component that includes the transistor $P_2$ and the voltage divider including the resistors $Rb_1$ and $Rb_2$. In another implementation, the feedback circuit components can be used to provide a feedback signal to the body of the input device of the current mirror, where the feedback signal has some relation to the difference between in the supply voltage $V_{IN}$ and the output voltage $V_{OUT}$. In an exemplary alternative, the feedback circuit component can include a differential amplifier that determines the difference between the supply voltage $V_{IN}$ and output voltage $V_{OUT}$ and feeds that difference back to the body of the current mirror input device, such as the transistor $P_0$. In another exemplary alternative, the transistor P2 can be eliminated and the voltage divider is coupled directly to the output $V_{OUT}$. This alternative configuration does not isolate the voltage divider and the drain to source voltage Vds of each transistor $P_0$ and $P_1$ do not match when the supply voltage $V_{IN}$ is at a minimum, but this configuration still provides an improvement.

The gate to source voltage of the transistor $P_0$ is adjusted in response to changes in the drain to source voltage of the transistor $P_1$ in a way that minimizes the change in drain current of the transistor $P_1$ for changes in the drain to source voltage of the transistor $P_1$. This effect is not linear. In some implementations, the feedback supplied to the body of the transistor $P_0$ is derived from a replica mirror with matching bias conditions.

FIG. 6 illustrates a graph showing exemplary simulation results for the current mirror of FIG. 5. FIG. 6 includes simulation results for 1:100 current mirror output variation with supply voltage. Curve 12 shows the simulated results for the current mirror circuit of FIG. 5. Curve 14 shows simulated results for the conventional current mirror circuit (FIG. 5 with $P_2$ and $Rb_2$ removed). For a supply voltage change from about 2.7V to about 5.5V, there is a change in output current of 65% for the conventional current mirror circuit, as shown in curve 14. When feedback is included as in the current mirror circuit of FIG. 5, the change in output current drops to at least about 6%, as shown in curve 12. There may be an at least approximately a 10:1 reduction in change of output current due to changing supply voltage.

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. A current mirror circuit comprising:

a current mirror comprising an input device and an output device coupled together; and a feedback circuit component coupled between the output of the current mirror and the input device, the feedback circuit component for adjusting a body to source voltage of the input device in response to a drain to source voltage of the output device.

2. The current mirror circuit as recited in claim 1, wherein the input device comprises a first metal-oxide-semiconductor transistor and the output device comprises a second metal-oxide-semiconductor transistor.

3. The current mirror circuit as recited in claim 2, wherein a source of the first transistor and a source of the second transistor are coupled to a voltage supply, and a drain of the second transistor comprises an output of the current mirror.

4. The current mirror circuit as recited in claim 3, wherein a gate of the first transistor is coupled to a gate of the second transistor, and the gate of the first transistor and the gate of the second transistor are coupled to a drain of the first transistor.

5. The current mirror circuit as recited in claim 1, wherein the feedback circuit component comprises a voltage divider coupled to the output of the current mirror, the voltage supply, and the body of the first transistor.

6. The current mirror circuit as recited in claim 5, wherein the feedback circuit component further comprises a third metal-oxide-semiconductor transistor coupled between the output of the current mirror and the voltage divider.

7. The current mirror circuit as recited in claim 6, wherein a size of the third transistor is the same as a size of the second transistor such that a gate to source voltage of the third transistor is the same as the gate to source voltage of the second transistor.

8. The current mirror circuit as recited in claim 1, wherein the feedback circuit component comprises a differential amplifier configured to receive as input the supply voltage and an output voltage at the output of the current mirror and to output a difference between the supply voltage and the output voltage, wherein the difference is used for adjusting the body to source voltage of the first transistor.

9. A current mirror circuit comprising:

a current mirror comprising a first transistor configured as an input device and a second transistor configured as an output device, the first transistor is coupled to the second transistor; and a feedback circuit component coupling an output of the current mirror to a body of the first transistor, wherein the feedback circuit component is configured to supply a body voltage to the body of the first transistor that is based on a difference between a supply voltage provided to the first transistor and the second transistor and an output voltage at the output.

10. The current mirror circuit as recited in claim 9, wherein the first transistor comprises a first metal-oxide-semiconductor transistor and the second transistor comprises a second metal-oxide-semiconductor transistor.

11. The current mirror circuit as recited in claim 10, wherein a source of the first transistor and a source of the second transistor are coupled to a the supply voltage, and a drain of the second transistor comprises the output of the current mirror.

12. The current mirror circuit as recited in claim 11, wherein a gate of the first transistor is coupled to a gate of the second transistor, and the gate of the first transistor and the gate of the second transistor are coupled to a drain of the first transistor.

13. The current mirror circuit as recited in claim 9, wherein the feedback circuit component comprises a voltage divider coupled to the output of the current mirror, a voltage supply that provides the supply voltage, and the body of the first transistor.

14. The current mirror circuit as recited in claim 13, wherein the feedback circuit component further comprises a third transistor coupled between the output of the current mirror and the voltage divider.

15. The current mirror circuit as recited in claim 14, wherein a size of the third transistor is the same as a size of the second transistor such that a gate to source voltage of the third transistor is the same as the gate to source voltage of the second transistor.

16. The current mirror circuit as recited in claim 9, wherein the feedback circuit component comprises a differential amplifier configured to receive as input the supply voltage and the output voltage and to output the difference between the supply voltage and the output voltage.

17. A circuit comprising:

a current mirror comprising a first transistor having a first source, a first gate, a first drain, and a first body, and a second transistor having a second source, a second gate, a second drain, and a second body, wherein the first gate is coupled to the second gate, and the first gate and the second gate are coupled to the first drain, further wherein the first source, the second source, and the second body are coupled to a voltage supply, wherein the second drain comprises an output of the current mirror; and a feedback circuit component coupling the output to the first body, wherein the feedback path comprises:

a third transistor having a third source, a third gate, a third drain, and a third body, wherein the third gate is coupled to the output, the third drain is coupled to ground, and the third body is coupled to the third source; and a voltage divider coupled to the third source, the voltage supply, and the first body, wherein the feedback path is configured to supply a body voltage to the first body that is based on a difference between a supply voltage provided by the voltage supply and an output voltage at the output.

18. The circuit as recited in claim 17, wherein at least one of the first transistor, the second transistor, or the third transistor comprise a metal-oxide-semiconductor transistor.

19. The circuit as recited in claim 18, wherein at least one of the first transistor, the second transistor, or the third transistor comprise a p-type metal-oxide-semiconductor transistor.

20. The circuit as recited in claim 17, wherein the feedback circuit component is coupled between the output and the first body.

* * * * *